US005451981A

United States Patent [19]

Drako et al.

[11] Patent Number: 5,451,981

[45] Date of Patent: * Sep. 19, 1995

[54] TEAR FREE UPDATES OF COMPUTER GRAPHICAL OUTPUT DISPLAYS

[75] Inventors: Dean Drako, Cupertino; Steven Roskowski, Sunnyvale, both of Calif.

[73] Assignee: Apple Computer, Inc., Cupertino, Calif.

[ * ] Notice: The portion of the term of this patent subsequent to Dec. 6, 2011 has been disclaimed.

[21] Appl. No.: 127,084

[22] Filed: Sep. 24, 1993

Related U.S. Application Data

[63] Continuation of Ser. No. 616,886, Nov. 21, 1990, abandoned.

[51] Int. Cl.[6] ..... G09G 1/16

[52] U.S. Cl. ..... 345/118; 345/200

[58] Field of Search ..... 345/189, 118, 119, 120, 345/190, 191, 193, 200; 395/118, 162–166

[56] References Cited

U.S. PATENT DOCUMENTS

| | | | |
|---|---|---|---|
| 4,435,792 | 3/1984 | Bechtolsheim | 365/230 |
| 4,594,587 | 6/1986 | Chandler et al. | 340/750 |
| 4,661,812 | 4/1987 | Ikeda | 340/799 |
| 4,737,780 | 4/1988 | Ishii | 340/750 |
| 4,757,312 | 7/1988 | Asai et al. | 340/750 |
| 4,803,475 | 2/1989 | Matsueda | 340/750 |
| 4,845,661 | 7/1989 | Shimada | 340/798 |
| 4,868,556 | 9/1989 | Murakami et al. | 340/750 |
| 4,953,120 | 8/1990 | Nishiyama | 340/711 |
| 5,291,188 | 3/1994 | McIntyre et al. | 345/200 |
| 5,371,513 | 12/1994 | Drako et al. | 345/118 |

FOREIGN PATENT DOCUMENTS

| | | |
|---|---|---|
| 0228135 | 7/1987 | European Pat. Off. . |
| WO85/04976 | 11/1985 | WIPO . |

*Primary Examiner*—Richard Hjerpe

*Attorney, Agent, or Firm*—Blakely, Sokoloff, Taylor & Zafman

[57] ABSTRACT

A method of eliminating frame tears from the output display in a computer system including the steps of determining a safe region for furnishing data to a frame buffer, selecting a value of a first interrupt to signal the beginning of the safe region, determining the position of the scan from the frame buffer, comparing the value of the position of the scan from the frame buffer and the value of the first interrupt, and transferring information to the frame buffer only in response to the interrupt indicating a safe region.

13 Claims, 4 Drawing Sheets

TEAR FREE UPDATES OF COMPUTER GRAPHICAL OUTPUT DISPLAYS

This is a continuation of application Ser. No. 07/616,886, filed Nov. 21, 1990, now abandoned.

BACKGROUND OF THE INVENTION

1. Field of the Invention

This invention relates to computer graphics displays and, more particularly, to methods and apparatus for rendering computer graphics displays tear free.

2. History of the Prior Art

The image presented on a computer output display is provided by continuously scanning information contained in a frame buffer to the output display. The frame buffer is a memory with sufficient storage space to contain information describing a single picture (or frame). The information stored in a frame buffer is scanned to the output display between sixty and seventy times each second in order to present the image. The image scanned to the output display is changed by changing the information stored in the frame buffer.

When a computer attempts to transfer information to a frame buffer during a period in which information is being transferred from the frame buffer to the output display, a tear in the output display may occur. This occurs because the information scanned to the output display as a single picture or frame in fact comes from two sequential frames. A portion of the image scanned to the display comes from what was intended to be one frame of the frame buffer while another portion of the display comes from what was intended to be a succeeding frame. This occurs because the data transfer to a frame buffer is not synchronized to the scan out of the frame buffer. Because of this, the raster beam may catch up with the transfer of information to the frame buffer from which the display is refreshed, or the transfer of information to the frame buffer may catch up with the raster beam so that the picture displayed in the window comes from two different frames of the frame buffer. Such an occurrence is called a "frame tear" and results in a flickering occurring on the output display. Although the flickering takes place over a very short period of time (a few frames), it is very disturbing to the viewer and unacceptable when producing an animated graphical output or a video display.

One way to cure image tearing is by double buffering the output to the display device. To accomplish this, two frame buffers are used. A first frame to be displayed is sent to the first frame buffer and stored. During this period in which the information is being placed in the first frame buffer, no information is scanned from that frame buffer to the output display; information is being scanned from a second frame buffer to the output display. Information may be scanned from the second frame buffer many times while the first frame buffer is being filled. Once the frame is completed within the first frame buffer and the frame in the second frame buffer has been completely scanned to the output display, the switch over occurs; the information in the first frame buffer is scanned to the output display. While information is being scanned to the output display from the first frame buffer, the succeeding frame is being placed in the second frame buffer. When the succeeding frame is completed in the second frame buffer and the frame in the first frame buffer has been completely scanned to the display, the frame in the second frame buffer is scanned to the output display while the first frame buffer is being filled with the next succeeding frame. The operation continues in this manner with changes being made only to one of the frame buffers while the information in the other frame buffer is being scanned to the output display.

Double buffering keeps information from being both written to and scanned from any single frame buffer during the same period of time. Consequently, no frame tearing occurs. However, double buffering doubles the size of the frame buffer memory required by a computer and substantially increases its cost. Generally, such arrangements are too costly for personal computers and are used only in high end work stations. Moreover, the arrangements necessary for providing windowing on an output display are quite complicated in a system using double buffering.

A method used to eliminate frame tearing using a single frame buffer utilizes an interrupt generated in response to the completion of the vertical scan of the output display to control the transfer of information to the frame buffer. For a short period following this interrupt signal the beam is moving from the end of the display back to the beginning, and no information is being scanned from the frame buffer to the display. During this interval, it impossible for a frame tear to occur; and information may safely be placed in the frame buffer. However, this vertical blanking time is insufficient if what is desired is to transfer information covering a large area of the output display. For example, the vertical blank interrupt signal may be used to transfer cursor information but generally will not work to transfer information for an area such as a window which may begin at any position and may include more information than might be transferred during the vertical blanking period.

SUMMARY OF THE INVENTION

It is, therefore, an object of the present invention to eliminate the problem of frame tears in computer systems.

It is another more specific object of the present invention to eliminate frame tears in a computer system using a single frame buffer.

These and other objects of the present invention are realized in a method of eliminating frame tears in a computer system comprising the steps of determining a safe region to start furnishing data to a frame buffer, selecting a value of a first interrupt to signal the beginning of the safe region, determining the position of the scan from the frame buffer, comparing the value of the position of the scan from the frame buffer and the value of the first interrupt, and transferring information to the frame buffer only in response to the interrupt indicating a safe region.

These and other objects and features of the invention will be better understood by reference to the detailed description which follows taken together with the drawings in which like elements are referred to by like designations throughout the several views.

NOTATION AND NOMENCLATURE

Some portions of the detailed descriptions which follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human lo operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to apparatus and to method steps for operating a computer in processing electrical or other (e.g. mechanical, chemical) physical signals to generate other desired physical signals.

DETAILED DESCRIPTION OF THE INVENTION

Figure 1:
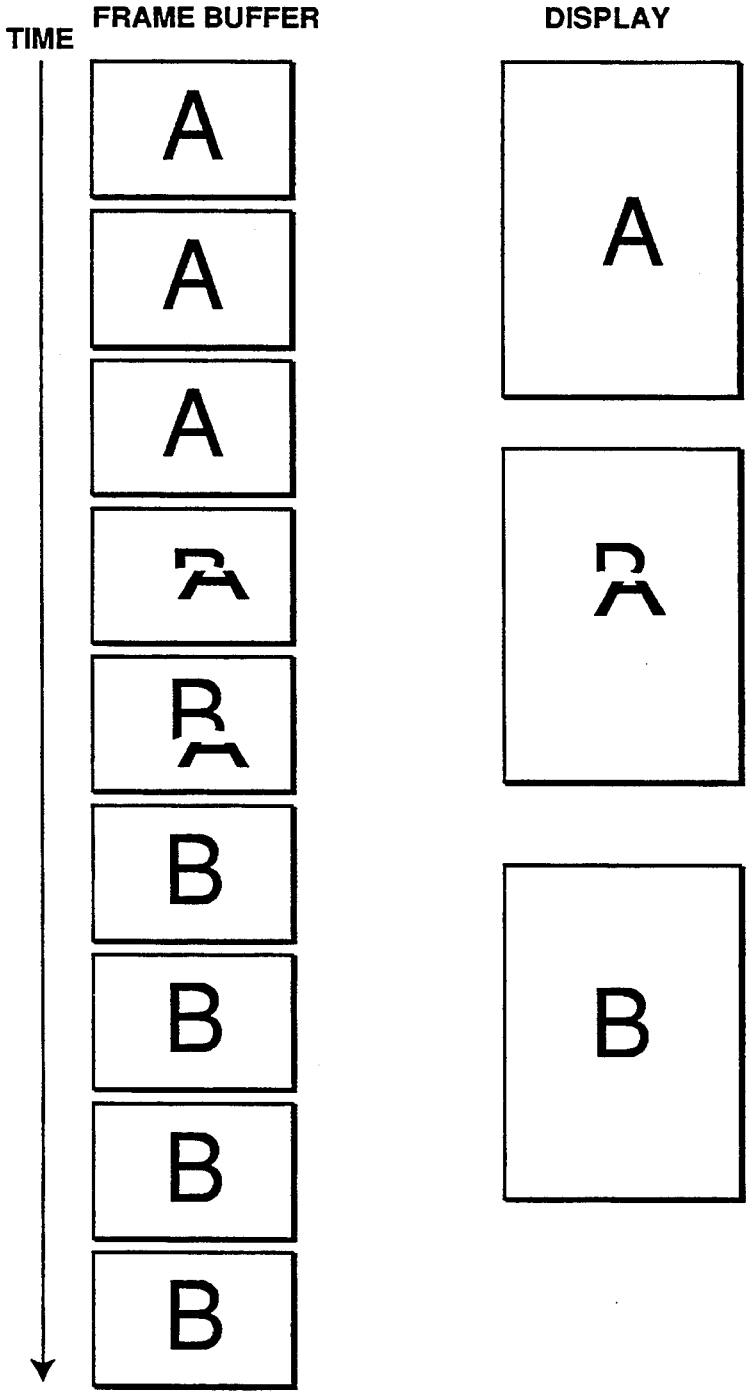
FIG. 1 is a diagram illustrating a number of different frames stored in a frame buffer together with a number of images presented on an output display.

Referring now to FIG. 1, there are shown on the left a series of illustrations which represent the information stored in a frame buffer at particular instants over a period of time. Beginning at the top of the figure, the frame buffer holds at a first time an image which represents what will appear as a capital "A" when presented on the output display. Preceding downwardly in the left column, the frame buffer holds at the second and third sequential instants of time, additional capital "A"s. For the sake of the description, the individual frame buffer images may be considered to be evenly spaced in time so that the second frame varies from the first by the same time interval as does the third from the second and so on through the remaining images.

Beginning at the fourth image from the top, the image in the frame buffer has begun to change. This occurs because information is being added to the frame buffer beginning at the top of the "A" in the frame buffer and continuing downwardly line by line. This is the typical manner in which information is transferred to a frame buffer, whether that information represents the entire display or a window in the display. The information transfer begins at an upper left corner of the area of interest and precedes from left to right and then downwardly to the next line where it continues from left to right. Throughout this specification, all information transfers to the frame buffer should be considered to occur in this manner.

The image has changed sufficiently at the next image down in the left column of FIG. 1 that it may be seen that a capital "B" is being placed in the frame buffer. At the time of the sixth image in the left column, the "A" has been entirely replaced by a "B". The final three images (seven, eight, and nine) are each a capital "B". This series of images illustrates the manner in which a typical frame buffer image is changed over a period of time.

To the right in FIG. 1 are illustrated three more images. These images are those which are actually scanned to the output display of the particular computer. These images are not, in fact, snapshots in time since the information is being scanned to the display line-by-line from top to bottom. Throughout this specification, all information transfers to the display should be considered to occur in this manner. Sometimes this information is scanned to the display while the information in the frame buffer from which the image is being scanned is changing. However, the upper image in the right column is scanned to the display during a period in which the frame buffer holds only the first image illustrated in the left hand column. Since the image held in the frame buffer for each of the overlapping periods of time is that of an "A", an "A" is produced on the output display.

The second image in the right hand column is scanned to the output display during a period which begins at the time the fourth image in the left column is held in the frame buffer. Although the image in the frame buffer is changing during the period of the scan out, the image which appears on the output display is close to what is shown in the fourth frame from the top in the left column. The image is made up of a portion of a capital "A" and a portion of a capital "B", the portions being determined by the point at which the scan out to the display occurs with respect to the transfer of information into the frame buffer. Since the image is the combination of two different pictures, a distorted image is scanned to the output display. Since the displayed image appears to be made of an image on the top with its bottom torn off and replaced by another image on the bottom, this is referred to as an image or frame tear. This occurs because information is being placed in the frame buffer while information is being scanned to the output display. It will be appreciated that the appearance of the second image on the display is disconcerting and undesirable. Finally, the third image appearing on the output display is a "B" since the frame buffer holds the same "B" image during all of the period during which the third image from the top in the right column is being scanned to the output display.

Figure 2:
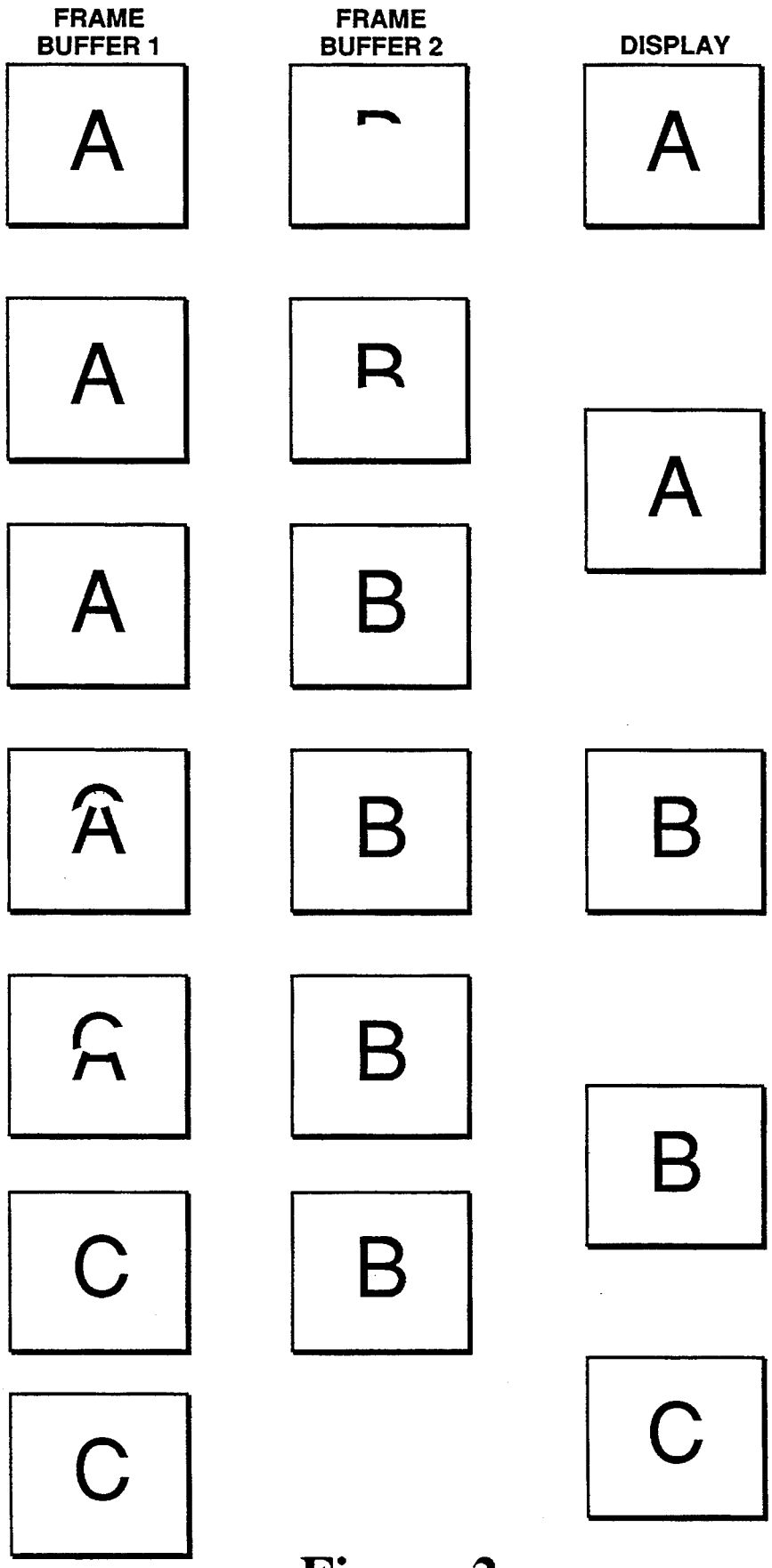
FIG. 2 is an illustration of a common method of eliminating frame tears.

As discussed, the reason for the appearance of the frame tear on the output display is that the filling of the frame buffer with information which is to be presented on the output display and the scanning of that information to the output display are not synchronized in the typical prior art computer system. In order to overcome this problem, expensive systems often use double buffering arrangements in order to eliminate frame tear. The manner in which this is accomplished is illustrated in FIG. 2 in which three columns of images are shown. The left hand column illustrates the images held at selected instants in a first frame buffer. The middle column illustrates the images held at the same selected instants in a second frame buffer. The third column illustrates the images which appear on the output display. Again, these last images are not instantaneous presentations but appear over the period required to scan an entire frame to an output display. The first image which appears on the output display is furnished from the first frame buffer. The first frame buffer holds an "A" during the entire period during which the image is scanned to the output display. During this period, no information is furnished to the first frame buffer; and, consequently, a tear free image is scanned to the display. However, during this same period, the second frame buffer is being filled with information representing a "B" as may be seen from the first three images in the center column of FIG. 2.

The next image on the output display is furnished from the second frame buffer after the completion of the scan to the display from the first frame buffer. During the interval in which this image is being scanned to the display, the second frame buffer receives no input. The second frame buffer thus holds a "B" during the entire period this image is scanned to the output display, and no tear occurs. At the same time, the "A" in the first frame buffer is being replaced by a capital "C" which is being transferred into the frame buffer over the period of the fourth and fifth instants illustrated in the left column of the figure.

Since the information is never being scanned to the output display during a period in which the frame buffer furnishing the information is being filled with new information, frame tears do not occur. However, the memory requirements of a system using two frame buffers are substantial and substantially increase the cost of the system. Consequently, double buffering is used only in expensive systems. Moreover, the hardware required to allow double buffered systems to display windows on the output display is quite extensive and further increases the cost of the system.

A second method of eliminating frame tears utilizes the vertical blanking interrupt signal provided by the circuitry which scans data to the output display to indicate a period during which information may be safely transferred into a frame buffer. During this vertical blanking period, no information is being transferred to the output display; consequently, the transfer of information into the frame buffer during this period will not cause a frame tear. Such an arrangement is typically utilized to eliminate frame tears in less expensive systems. It will eliminate frame tears for small objects such as the cursor. However, in a system in which a plurality of windows are provided simultaneously on an output display and in which information is transferred from different sources to the frame buffer, the vertical blanking interrupt provides insufficient information to eliminate frame tears.

Figure 3A:
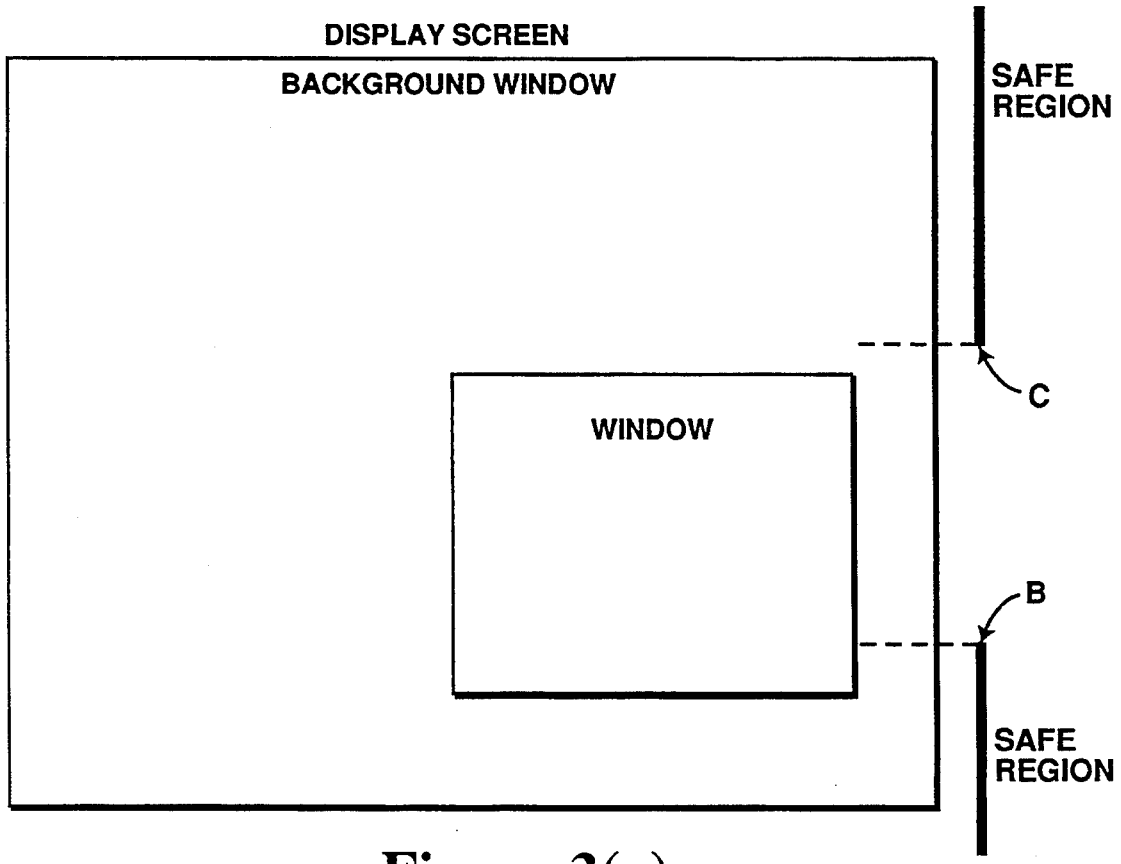
FIG. 3(*a*) and FIG. 3(*b*) are illustrations of a method in accordance with the present invention for eliminating frame tears in computer output displays.
Figure 3B:
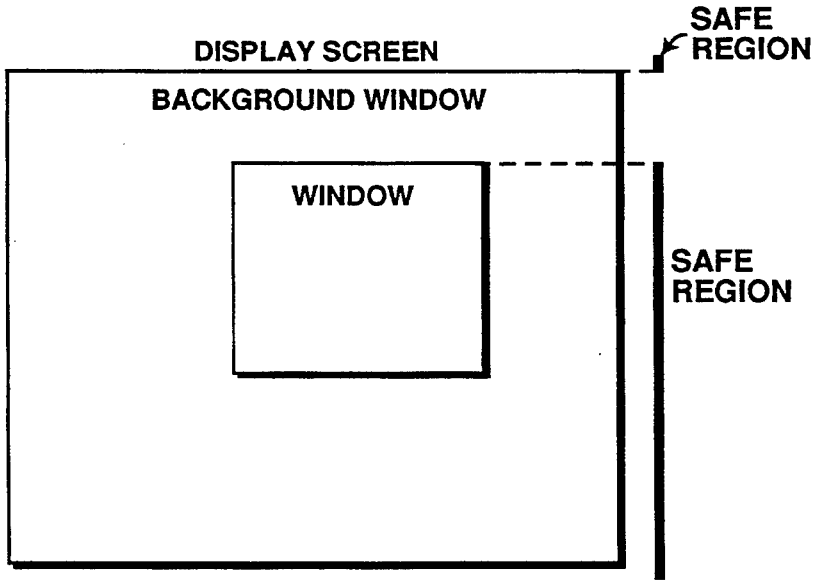

FIGS. 3(*a*) and (*b*) will help to illustrate the reason for this. In both FIGS. 3(*a*) and (*b*) are shown an output display in which an application program is running in the background window. Superimposed on the background window of the output display is a smaller window in which a second application program is running. Information may be transferred to the window of either of the application programs under control of the central processor. However, the transfer of information to either the large or the small window illustrated occurs whenever the processor determines that a change to the display for the program running in that window is needed. The transfer of information to either the large or the small window is not synchronized with the scanning of information to the display for the windows. The scan to the display starts at the upper left hand corner of the larger window and precedes line-by-line from left to right. No portion of the smaller window is scanned to the display until almost half of the larger window has been displayed, and the scan to the smaller window is completed on the display before the scan to the larger window is completed. Since the two windows are scanned to the display during different but overlapping time intervals, the periods during which transfer of information to the frame buffer may occur varies for each window. Because the smaller window does not cover the whole display, the period during which information may be safely transferred to the frame buffer without causing a frame tear ( the safe transfer time) is not indicated by the vertical interrupt signal. Moreover, the period of the vertical interrupt is insufficient to allow objects the size of the small window shown to be updated during a single vertical blanking period. Thus, some better way of handling the problem of frame tears is necessary.

In order to obtain a better understanding of the periods during which information may actually be transferred to a frame buffer, it is necessary to consider the operation of scanning information to the display. During scanning, the information in the frame buffer is scanned a line at a time to the display beginning with the information stored in the frame buffer describing the left hand corner of the top line of the display. The scanning precedes to the right along that line until it reaches the end of the line. It then skips to the far left of the next to the top line to be shown on the display. It continues in this manner until the bottom right corner of the display is reached and the vertical blanking occurs while the raster skips back to the upper left hand corner of the display. It will be seen that for the complete display area, if the transfer of information into the frame buffer precedes at a faster rate than the scanning of information to the frame buffer, then if information begins to transfer into the frame buffer at the time of the vertical interrupt signal, then the scanning operation will never catch up with the transfer of information into the frame buffer; and no frame tear will occur. However, if in a more typical arrangement in which the transfer of information into the frame buffer precedes at a slower rate than information is scanned to the display, the raster beam will catch up with the transfer; and a tear will occur. On the other hand, if the transfer into the frame buffer occurs only after the raster beam has passed a particular point, then a slower transfer rate into the frame buffer will not affect the particular frame, provided the rate is not too slow. Consequently, the rate at which information is placed in the frame buffer and the position at which transfer begins are two determining factors in where transfer may begin without causing a frame tear.

The same factors control the transfer of information into the smaller window on the output display. However, since the beginning of scanning from the frame buffer to the display for such a window does not occur until the particular line of the display at which the window starts is reached by the raster beam, and since scanning for the window often ends before the bottom of the display, more latitude is available for transferring information into the frame buffer for such smaller windows.

In general, in the display of FIGS. 3(*a*) and (*b*), if the contents of the small window are transferred to the frame buffer in a fixed maximum amount of time at a fixed rate, then a safe start time may be determined for accomplishing the transfer in which frame tearing cannot occur. These safe start times occur at least during the safe regions which are illustrated in FIGS. 3 (*a*) and (*b*) by the heavy vertical lines to the right of the display. The regions in FIG. 3(*a*) indicate a situation in which a frame buffer is filled faster that the display is scanned while FIG. 3(*b*) indicates one in which a frame buffer is filled more slowly than the display is scanned. For example, in FIG. 3(*a*), if the display raster beam is in the upper safe region and transfer of information to the window area in the frame buffer commences, the raster beam will not catch up to the transfer of information even though the rates of transfer are different. If the raster beam is in the lower safe region of the display in FIG. 3(*a*), the transfer of information to the window in the frame buffer will not catch up with the raster beam. In FIG. 3(*b*), the safe region starts higher since the raster beam is traveling faster than the transfer of information and the transfer will never catch up to the scan of the display. In either case, only one frame appears in the window and frame tearing is eliminated.

A major complicating factor occurs, however, if the program running in a window is video, a television program for example. Video information is typically transferred into the computer system through a frame grabber arrangement which includes a buffer in which individual frames of the incoming lo video are placed. The information may then be transferred out of the frame grabber buffer into the frame buffer. It will be recognized that this transfer into the frame buffer from the frame grabber buffer will be subject to the same frame tear problem. It can only be accomplished during periods in which information being transferred from the frame grabber buffer is not being changed.

U.S. patent application Ser. No. 07/528,242, entitled Apparatus For Generating Programmable Interrupts, Drako et al., filed May 24, 1990, describes an arrangement for generating signals at any of selected intervals during the scanning of a frame to an output display. The specification describes an arrangement for selecting interrupts which may be programmed to occur at any point during the scan of information to an output display and thus may be made to indicate the beginning and ending lines of any windows displayed.

Basically, the arrangement comprises a control circuit for a computer output display which cooperates with the typical timing generator circuit for providing synchronization and blanking signals for a display monitor. The control circuit uses the portion of the timing generator circuit which furnishes signals indicating the end of a display line, the portion for counting the number of lines of the computer display traversed by the raster beam, and the portion for providing a signal to the timing generator circuit when all of the lines of the display have been traversed. The control circuit includes apparatus for selectively providing a line number at which an interrupt is desired and apparatus for comparing the result of the count by the raster beam line counter and the number of the line at which an interrupt is desired to generate an output signal when the two are equal. This output signal is then used to generate an interrupt signal. If desired, a plurality of circuits for selectively providing a line number at which an interrupt is desired and apparatus for comparing the result of the raster beam line count and the number of all of the lines at which an interrupt is desired may be used to produce a plurality of such interrupt signals.

The positions indicated by these interrupt signals may be used with the position of the raster beam available in the timing generator circuitry and information regarding the rate of transfer of information into the frame buffer to produce tear free updates of the output display.

Presuming the rate of transfer is constant into the frame buffer and faster than the scan rate to the display (FIG. 3(*a*)), in the simplest case in which the input to the device transferring the information to the frame buffer is not changing, a determination provided by an interrupt that the raster beam has passed a particular point toward the end of a window (point B) indicates that the information transfer to the frame buffer for that particular window may start. If the transfer begins anywhere in the region when the beam is from point B to the bottom of the display and from the top of the display down to C (including any overscan regions), the transfers will complete without causing a frame tear. The region between B and C thus constitutes the safe region for beginning to transfer information to the frame buffer where the rate of transfer and the rate of the scan are both constants. It is clear that the information provided by the programmable interrupts and the raster beam position are sufficient to determine this safe region.

On the other hand, presuming the rate of transfer is constant into the frame buffer and slower than the scan rate to the display, in the simplest case in which the input to the device transferring the information to the frame buffer is not changing, FIG. 3(*b*) illustrates the safe region for beginning the transfer of information to the frame buffer.

In a more complicated case in which information provided to the source furnishing information to the frame buffer may change during the transfer to the frame buffer, circuitry such as that described in the aforementioned patent application for providing programmable interrupts must also be included in the arrangement for transferring information to the source buffer. The transfer may (if rapid enough) occur just as the fill of the source of information is completed as signalled by an interrupt similar to the vertical blanking signal. If the source transfers only full frames of information, then only the instantaneous position of the scan of the source buffer is necessary. If the source, however, is able to transfer windows of information from a larger frame, then interrupts indicating safe areas are desirable. By including a second set of such circuitry, the position of the scan of information from the source buffer being transferred and the interrupt positions for that buffer may be utilized to determine a safe period during which information transfer may be started from the source buffer without incoming information to the source buffer causing a frame tear during the transfer to the frame buffer in essentially the same manner as discussed with regard to the frame buffer. Only when this safe period and the safe period determined for scanning information from the frame buffer to the output display coincide may information begin to be provided from the source buffer to the frame buffer.

Figure 4:
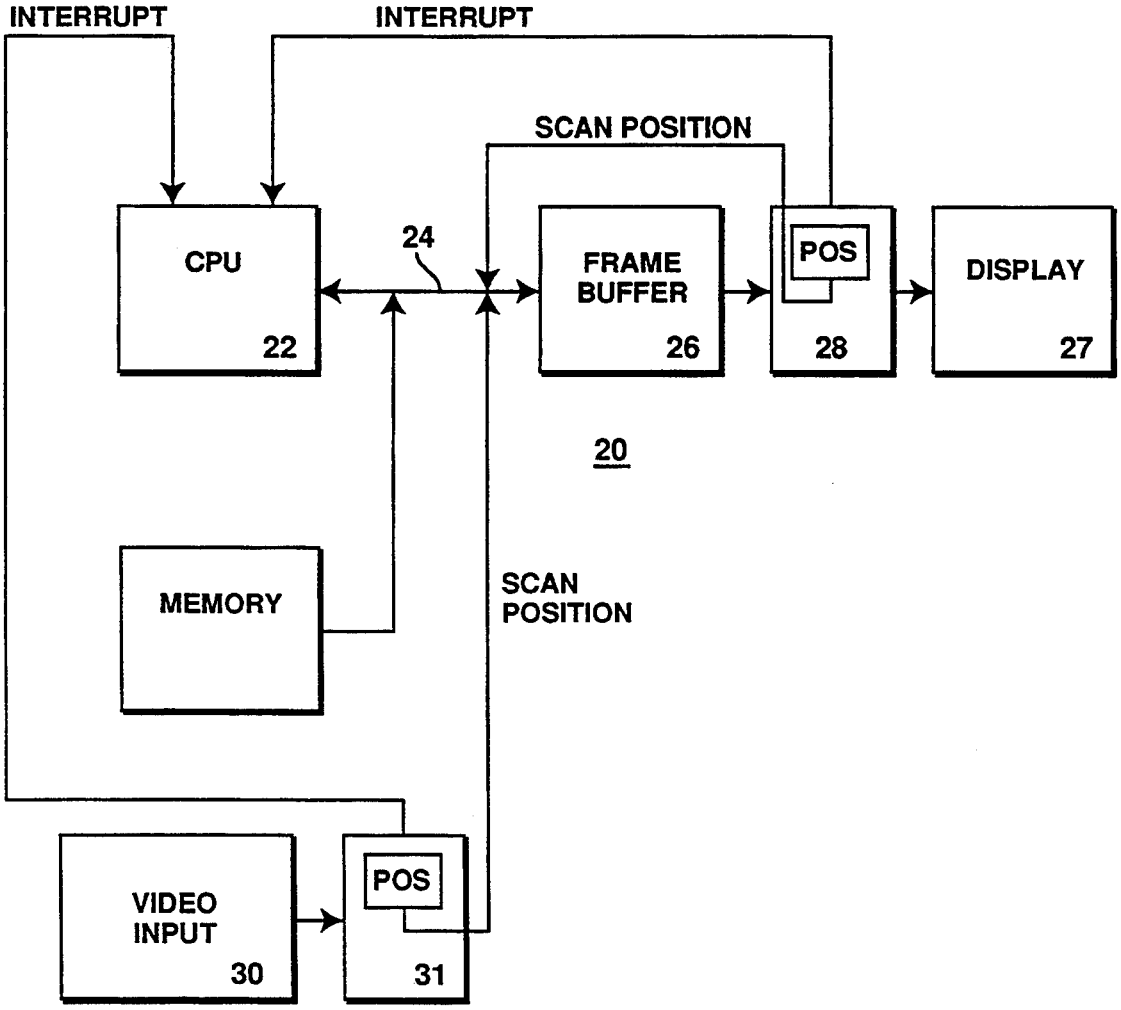
FIG. 4 is a block diagram illustrating an arrangement for carrying out the present invention.

FIG. 4 illustrates in block diagram form an arrangement 20 constructed in accordance with the invention which may be used to accomplish tear free updates of the output display. The arrangement 20 includes a central processing unit 22 which provides output information on a system bus 24. The information on the bus is transferred to a frame buffer memory 26 which is conventionally constructed of video random access memory. Video random access memory includes an arrangement for shifting out information from the frame buffer memory 26 an entire line at one time so that it may be rapidly transferred to a display 27 by a digital-to-analog converter circuit 28. The addressing information on the bus 24 is transferred to the frame buffer memory 26 to control the position in the frame buffer memory 26 to which each pixel presented on the bus 24 is directed.

Timing signals for the display 27 are generated using pulses from a clock oscillator circuit within the digital-to-analog converter circuit 28 which provides a pulse for each pixel to be presented on the output display 27. These clock pulses are counted to determine at each instant the position of the scan to the display 27. For example, in a typical arrangement, the clock pulses are provided to a pixel counter and a comparator to provide signals to indicate the completion of each line of the display. A horizontal line counter counts the lines as they are displayed on the display 27 and compares the count with the total number of lines to be presented on the display 27 so that when the values compare, the last line of the display 27 has been reached. A signal is then sent to generate the vertical blanking signal causing the beam to retrace to the beginning of the display 27.

In the arrangement of the aforementioned patent application, these horizontal and vertical positions being scanned are also compared with the beginning and ending positions of windows to be displayed and with programmed interrupt positions. The comparison of the scan position and the programmed interrupt positions is used to provide the desired interrupts for each window to be displayed. In order to accomplish this, the value held in the horizontal line counter is also transferred to a comparator which receives a second signal from a horizontal interrupt position register. The value in the horizontal interrupt position register is provided by the central processing unit 22. Since the value in any horizontal interrupt position register is programmable, the central processing unit 22 may select the position on the display 27 at which the comparator provides an output signal to generate an interrupt which may be selected to occur at a predetermined position to indicate the start of one of the safe regions so that the frame buffer memory 26 may receive information in a selected window at a time at which the receipt will not interfere with the raster beam and no frame tearing will occur. A particular arrangement described may include a number (for example, eight) individual horizontal interrupt position registers so that central processing unit interrupts may be generated for a number of different windows during each refresh of the display 27.

The central processing unit 22 sets up the operation by which a transfer of information from a video input system 30 to the frame buffer 26 is to occur. The central processing unit 22 receives an interrupt from the positioning portion of control circuitry 31 associated with the video input system 30. The central processing unit 22 checks the position register of the frame buffer 26. If the position register of the frame buffer is in an acceptable position, the central processing unit 22 begins the transfer of the information. If the central processing unit 22 receives an interrupt from the control circuitry 28, it checks the position register of the video input circuitry 30. If that register shows the input is in a safe region, the transfer of the video input information to the frame buffer is started.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A method of eliminating frames tears from the output display in a computer system which transfers data to a target window of a frame buffer during periods in which data is being transferred from the frame buffer to the output display without interrupting the transfer of data to the output display from the frame buffer, which computer system generates a plurality of signals each of which indicates a different scan line position on the output display, said method comprising the steps of selecting a value of a first scan line position on the output display at the beginning of a safe region for furnishing data to a frame buffer which scan line position may be any line position, the safe region corresponding to a portion of the frame buffer which is scanned and transferred to the output display, determining the position of a line of the display which is presently being scanned from the frame buffer, generating an interrupt when the value of the position of the line of the display which is presently being scanned from the frame buffer and the value of the first scan line position coincide, and transferring data to the target window of the frame buffer only in response to the interrupt indicating that the safe region of the frame buffer is coincidentally being scanned and output to the output display wherein data written to a particular location of said target window is not simultaneously scanned for display.

2. A method of eliminating frame tears from the output display in a computer system as claimed in claim 1 further comprising the steps of selecting a value of a second position to signal a beginning of a safe region for deriving data to be scanned from a source of data for a frame buffer which source of data is both transferring and receiving data simultaneously, determining the present position of the scan from the source of data for a frame buffer, generating a second interrupt when the value of the present position of the scan from the source of data and the value of the second position coincide, and transferring information to the target window of the frame buffer only in response to the concurrence of the interrupt indicating a safe region for the frame buffer and the second interrupt which indicates a safe region for deriving data to be scanned from the source of data for the frame buffer.

3. A method of eliminating frame tears from the output display in a computer system as claimed in claim 2 in which the second position to signal a beginning of the safe region for deriving data to be scanned from the source of data coincides with the end of the scan from the source of data for the frame buffer.

4. A method of eliminating frame tears from the output display in a computer system as claimed in claim 1 in which the value of a first scan line position on the output display at the beginning of the safe region for furnishing data to the frame buffer is programmable.

5. A method of eliminating frame tears from the output display in a computer system, said method comprising the steps of determining safe regions of the frame buffer for starting to furnish data to a frame buffer for a plurality of window areas to be displayed on an output display, selecting a value of a scan line position indicating the beginning of a safe region for each of the windows, determining the position of the scan from the frame buffer that is being displayed, comparing the value of the position of the scan from the frame buffer and the value of the scan line position at the beginning of a particular safe region, generating an interrupt when the value of the scan line position of the scan from the frame buffer and the value of the scan line position at the beginning of the particular safe region are equal, and transferring information to a particular window area of the frame buffer that is associated with the particular safe region of the frame in response to the interrupt indicating that the particular safe region of the frame buffer is coincidentally being scanned and output to the output display and wherein data written to a particular location of said particular window area is not simultaneously scanned for display.

6. A method of eliminating frame tears from the output display in a computer system as claimed in claim 5 in further comprising the steps of determining a safe region for deriving data from a source of data for a frame buffer which source of data both transfers and receives data simultaneously, selecting a value of a scan line position at the beginning of the safe region for the source of data for a frame buffer, determining the position of the scan from the source of data for a frame buffer, generating an interrupt when the value of the position of the scan from the source of data for a frame buffer and the value of the scan line position at the beginning of a safe region for the source of data are equal, and transferring information to a window area the frame buffer only in response to the coincidence of the interrupt indicating a safe region associated with the window area of the frame buffer and the interrupt indicating a safe region for the source of data for the frame buffer.

7. In a computer system having a central processor coupled to a bus, a memory coupled to said bus, a frame buffer coupled to said bus, and a display unit coupled to said frame buffer through a digital to analog converter, a method for eliminating display tears within said display unit, said method comprising the steps of:

defining a first window region of said frame buffer for receiving display data;

determining a safe region of scan lines within said frame buffer, said safe region associated with said first window region, said safe region comprising a start scan line and an end scan line;

scanning lines of said frame buffer to display said frame buffer display data on said display unit; and updating said display data within said first window region of said frame buffer by loading said first window region of said frame buffer with new display data, said, step of loading initiated only when said step of scanning lines of said frame buffer coincidentally scans lines that are within said safe region of said frame buffer and wherein data written to a particular location of said first window region is not simultaneously scanned by said step of scanning.

8. A method of eliminating display tears within said display unit as described in claim 7 wherein said step of loading said first window region comprises the step of generating an interrupt to initiate said loading when said step of scanning scans a scan line for display that coincides with said start scan line of said safe region of said frame buffer.

9. A method of eliminating display tears within said display unit as described in claim 7 wherein said safe region of said frame buffer is defined for a scanning rate of said scanning step that exceeds a loading rate of said loading step.

10. A method of eliminating display tears within said display unit as described in claim 7 wherein said safe region of said frame buffer is defined for a loading rate of said loading step that exceeds a scanning rate of said scanning step.

11. In a computer system having a central processor coupled to a bus, a memory coupled to said bus, a frame buffer coupled to said bus, and a display unit coupled to said frame buffer through a digital to analog converter, a method of filling a first window region of said frame buffer in such method as to eliminate display tears within said display unit, said method comprising the steps of:

determining a safe region of scan lines within said frame buffer, said safe region associated with said first window region, said safe region comprising a start scan line and an end scan line;

scanning lines of said frame buffer to display said frame buffer display data on said display unit, said step of scanning performed at a scanning rate;

generating an interrupt when said step of scanning scans a scan line of said frame buffer that coincides with said start scan line; and but that coincides with said start scan line; and loading said first region of said frame buffer with new display data, said step of loading initiated in response to said interrupt and performed at a loading rate and wherein data written to a particular location of said first window region is not simultaneously scanned by said step of scanning.

12. A method of filling a first region of said frame buffer as described in claim 11 wherein said safe region of said frame buffer has a first configuration defined by said scanning rate exceeding said loading rate.

13. A method of filling a first region of said frame buffer as described in claim 11 wherein said safe region of said frame buffer has a second configuration defined by said loading rate exceeding said scanning rate.

* * * * *